US008096372B2

(12) United States Patent
Shen et al.

(10) Patent No.: US 8,096,372 B2
(45) Date of Patent: Jan. 17, 2012

(54) CUTTER GEOMETRY FOR INCREASED BIT LIFE AND BITS INCORPORATING THE SAME

(75) Inventors: Yuelin Shen, Houston, TX (US); Youhe Zhang, Tomball, TX (US); Sujian Huang, Shunyl District (CN); Peter T. Cariveau, South Jordan, UT (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 11/781,648

(22) Filed: Jul. 23, 2007

(65) Prior Publication Data

US 2008/0296070 A1 Dec. 4, 2008

Related U.S. Application Data

(60) Provisional application No. 60/833,127, filed on Jul. 24, 2006.

(51) Int. Cl.
*E21B 10/08* (2006.01)

(52) U.S. Cl. ..... 175/331; 175/336; 175/337; 175/430

(58) Field of Classification Search ..... 175/331, 175/337, 430, 336

See application file for complete search history.

(56) References Cited

U.S. PATENT DOCUMENTS

| | | | | |
|---|---|---|---|---|
| 4,224,380 | A | 9/1980 | Bovenkerk et al. | |
| 4,572,722 | A | 2/1986 | Dyer etal. | |
| 4,797,241 | A | 1/1989 | Peterson et al. | |
| 5,383,527 | A * | 1/1995 | Azar | 175/431 |
| 5,662,183 | A | 9/1997 | Fang | |
| 5,765,095 | A | 6/1998 | Flak et al. | |
| 6,287,360 | B1 | 9/2001 | Kembaiyan et al. | |
| 6,315,066 | B1 | 11/2001 | Dennis | |
| 6,353,771 | B1 | 3/2002 | Southland | |
| 6,461,401 | B1 | 10/2002 | Kembaiyan et al. | |
| 6,843,333 | B2 * | 1/2005 | Richert et al. | 175/379 |
| 7,090,034 | B2 * | 8/2006 | Rives | 175/53 |
| 2003/0217868 | A1 * | 11/2003 | Witman et al. | 175/426 |
| 2005/0015229 | A1 | 1/2005 | Huang | |
| 2005/0080595 | A1 | 4/2005 | Huang | |
| 2005/0096847 | A1 | 5/2005 | Huang | |
| 2005/0133272 | A1 | 6/2005 | Huang et al. | |

(Continued)

FOREIGN PATENT DOCUMENTS

WO 9214906 9/1992

(Continued)

OTHER PUBLICATIONS

Combined Search and Examination Report dated Nov. 15, 2007 for corresponding Application No. GB0714435.5, (3 pages).

(Continued)

*Primary Examiner* — Jennifer H Gay
*Assistant Examiner* — Yong-Suk Ro
(74) *Attorney, Agent, or Firm* — Osha Liang LLP

(57) ABSTRACT

An improved cutter for fixed cutter drill bits includes a base portion with a longitudinal axis that extends through a center of the base portion and a cutting face which is generally centered with the base portion. The cutting face has a periphery edge geometry comprising a first arcuate segment and a second arcuate segment spaced apart and arranged opposite each other with linear edge segments disposed there between forming sides of the cutting face. The cutting face spans a maximum edge-to-edge dimension L in a first direction that corresponds to a major axis of the cutting face. The cutting face spans a maximum edge-to-edge dimension W in a second direction, which is perpendicular to the first direction, and W is less than L.

30 Claims, 7 Drawing Sheets

U.S. PATENT DOCUMENTS

| | | | | |
|---|---|---|---|---|
| 2005/0247492 | A1 | 11/2005 | Shen et al. | |
| 2006/0032677 | A1* | 2/2006 | Azar et al. | 175/430 |
| 2008/0006446 | A1* | 1/2008 | Stowe et al. | 175/263 |
| 2008/0264696 | A1* | 10/2008 | Dourfaye et al. | 175/428 |

FOREIGN PATENT DOCUMENTS

| | | |
|---|---|---|
| WO | 9929465 | 6/1999 |
| WO | 0034001 | 6/2000 |
| WO | 2008006010 | 1/2008 |

OTHER PUBLICATIONS

Examination Report for GB Application No. GB0714435.5, dated Apr. 24, 2009, (1 page).

Examination Report for corresponding Canadian Application No. 2,595,048, dated Jun. 17, 2009, (3 pages).

Office Action issued in Canadian Application No. 2,595,048 dated Jul. 20, 2010 (3 pages).

* cited by examiner

CUTTER GEOMETRY FOR INCREASED BIT LIFE AND BITS INCORPORATING THE SAME

CROSS-REFERENCE TO RELATED APPLICATIONS

This application claims priority, pursuant to 35 U.S.C. §119(e), to U.S. Provisional Application No. 60/833,127 filed Jul. 24, 2006. That application is incorporated by reference in its entirety.

BACKGROUND OF INVENTION

1. Field of the Invention

The present invention relates to drill bits and more particularly to improved cutter geometries for fixed cutter drill bits and cutters and drill bits incorporating the same.

2. Background Art

Fixed cutter drill bits are widely used in the petroleum and mining industry for drilling wellbores through earth formations. The bits typically include a bit body with a threaded connection at a first end for attaching to a drill string and cutting structure formed at an opposite end for drilling through earth formation. The cutting structure typically includes a plurality of blades that extend radially outwardly from a longitudinal axis of the bit body. Ultrahard compact cutters are typically mounted in sockets formed in the blades and affixed thereto by press fitting or brazing. Fluid ports also may be positioned in the bit body to distribute fluid around the cutting structure of the bit and flush formation cuttings away from the cutters and borehole bottom during drilling.

Cutters used for fixed cutter drill bits typically comprise ultrahard compacts which include a layer of ultrahard material bonded to a substrate of less hard material through a high pressure/high temperature (HP/HT) sintering process, a brazing process, mechanical locking, or other means known in the art. Cutters are conventionally cylindrical in form with circular cross sections.

In mounting cutters on a bit a trade off exists between the depth of cutter setting into the bit body and the remaining cutter exposure available for drilling. Cutters are typically mounted with only about one-half of the cutter body exposed for drilling, with the other half being brazed into a socket formed in the bit body. For drilling applications where cutters may become exposed to high impact loads, such as in drilling rock formations tough in shear or in high speed drilling applications, more than half of the cutter body surface may be brazed into the cutter socket to provide sufficient braze strength for retaining the cutters in place during drilling. However, this deeper setting reduces the amount of cutter exposure remaining for drilling.

As cutters wear during drilling, an ever increasing wear flat forms at the cutting edges which increasingly slows down the rate of penetration (ROP) of the bit and increases the weight on bit required to maintain drilling. As the size of the wear flat increases, the heat generated at the cutting edge also increases and the ability of the drilling fluid to cool and clean the cutter decreases. The drilling life of a bit (bit life) is frequently limited by the amount of wear the cutters can experience before the displaced formation continuously interferes with the outer surface of the bit body and greatly retards the drilling rate. For conventional cutters, this wear amount is normally less than one-half of the cutter's diameter.

In many applications, conventional cutters do not provide the desired clearance between the cutting edge and the supporting bit body surface to prolong bit life. Also, because of the limited stand-off provided by conventional cutters, sufficient cooling and cleaning of the cutters may not be accomplished, especially when the entire exposed portion of a cutter becomes embedded in the earth formation leaving no room for drilling fluid to flush across the cutting face.

To overcome deficiencies noted for conventional cutters, elliptical cutters have been proposed as disclosed in PCT Publication No. WO 9214906 (Simpson et al). Elliptical cutters can be mounted on a bit with their major axes projecting outwardly from the bit body to provide increased cutting edge extension from the bit body surface. One problem associated with elliptical cutters is that their narrow cutting tips make them more susceptible to impact fracture during drilling, especially when exposed to higher impact loads, such as those associated with harder formation and higher speed drilling. Elliptical cutters are also significantly more difficult and expensive to manufacture than conventional circular cutters. Additionally, in many applications, the drilling life of the bit is still limited by the amount of wear the cutters can experience before formation continuously interferes with the bit body and greatly retards the drilling rate.

Asymmetric cutters have also been proposed as disclosed in U.S. Pat. No. 5,383,527 (Azar). These asymmetric cutters include a cylindrical base portion at one end and an asymmetrical cutting face at the other end which projects beyond the wall of the base portion towards a surface to be drilled. Asymmetric cutters advantageously provide broader cutting tips and a larger diamond volumes at the cutting face exposed for drilling than an elliptical cutter of equivalent extension. However, the geometry of the proposed asymmetric cutters also makes them more difficult and expensive to manufacture than conventional circular cutters.

Accordingly, a cutter geometry providing increased bit life, especially for use in harder formation and/or high speed drilling applications, along with reduced difficulty and/or expense in manufacture is desired.

SUMMARY OF INVENTION

In one aspect the present invention relates to an improved cutter for a fixed cutter drill bit. The cutter includes a base portion at one end having a longitudinal axis that extends through a center of the base portion and a cutting face disposed at an opposite end which is generally centered with the base portion such that the longitudinal axis extends through or proximal a center of the cutting face. A periphery edge of the cutting face includes a first arcuate segment and a second arcuate segment spaced apart and arranged opposite each other with linear edge segments disposed there between forming sides of the cutting face between the first and second arcuate segments. The cutting face spans a maximum edge-to-edge dimension L in a first direction corresponding to a major axis of the cutting face which intersects the first and second arcuate segments. The cutting face spans a maximum edge-to-edge dimension W in a second direction perpendicular to the first, wherein W is less than L.

In another aspect, the present invention relates to methods for forming an improved oblong cutter in accordance with the present invention.

In another aspect, the present invention relates to a fixed cutter drill bit having one or more cutters with an improved oblong geometry in accordance with the present invention to provide increased drilling life for the bit.

In another aspect, the present invention relates to a fixed cutter drill bit having improved oblong cutters mounted thereon in an optimized orientation to provide increased bit life.

Other aspects and advantages of the invention will be apparent from the following description and the appended claims.

DETAILED DESCRIPTION

Figure 1:
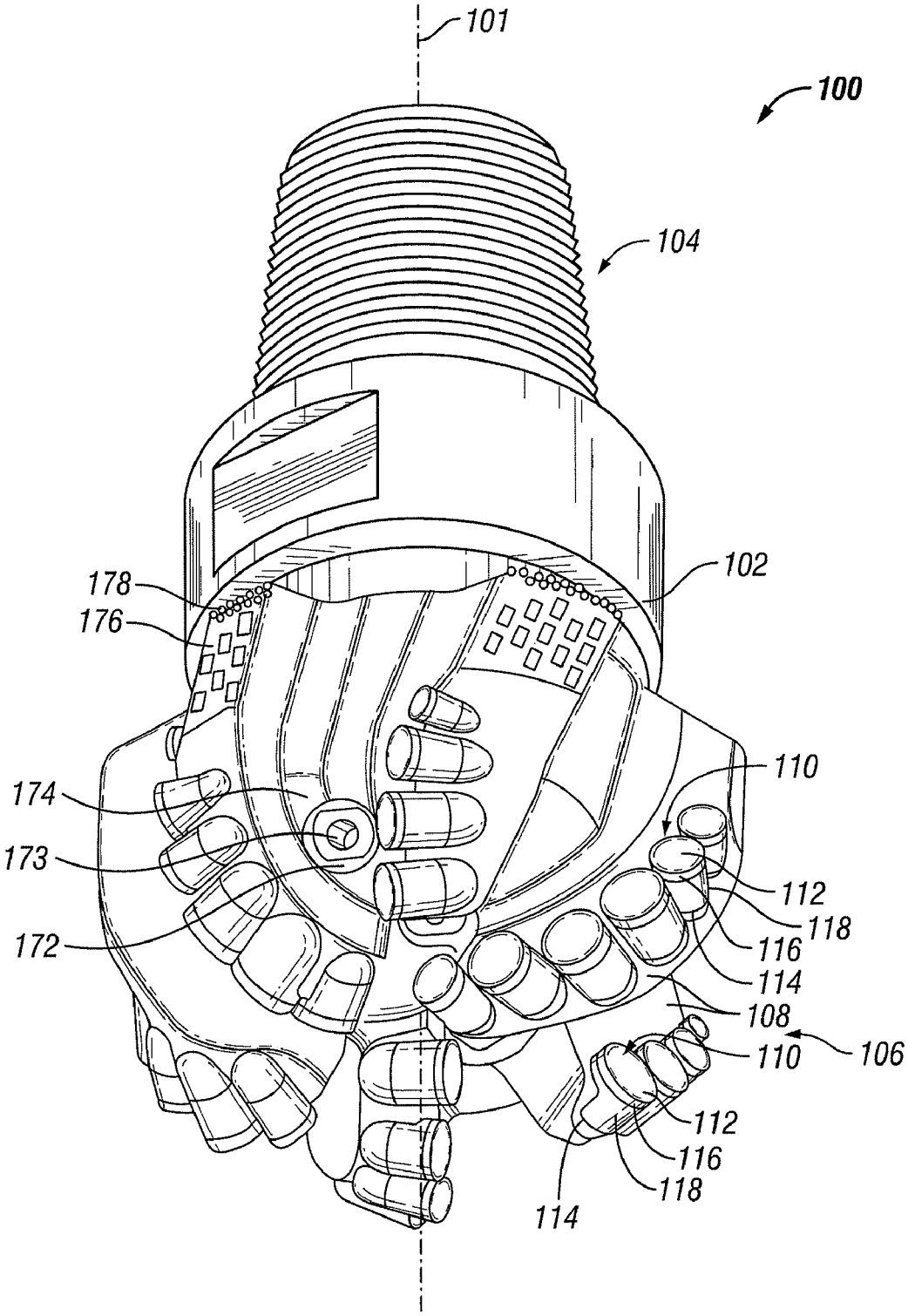
FIG. 1 (Prior Art)
FIG. 1 shows an elevation view of a conventional fixed cutter drill bit.

One example of a conventional fixed cutter drill bit is shown in FIG. 1. The bit 100 includes a bit body 102 with a threaded connection at a first end 104 for attaching to a drill string and cutting structure disposed at a second end 106 for cutting through earth formation. The cutting structure includes a plurality of blades 108 that extend radially outwardly from a longitudinal axis 101 of the bit at the second end 106. Circular cutters 110 are mounted on the blades 108 and affixed thereto by press fitting or brazing them into circular sockets 114 formed on the blades 108. Each of the cutters 110 includes a cutting face 112 formed of ultrahard material 116 bonded to a substrate 118 of less hard material. The bit 100 also includes fluid ports 172 with nozzles 173 disposed therein for distributing fluid flow around the cutting structure to wash formation cuttings away from the cutters and bottom of the wellbore during drilling. The bit also includes other features including fluid passageways 174 formed between adjacent blades, gage pads 176 formed at the ends of blades, junk slots formed between gage pads 176, and back reaming elements 178 disposed along edges of the gage pads 176.

Figure 2:
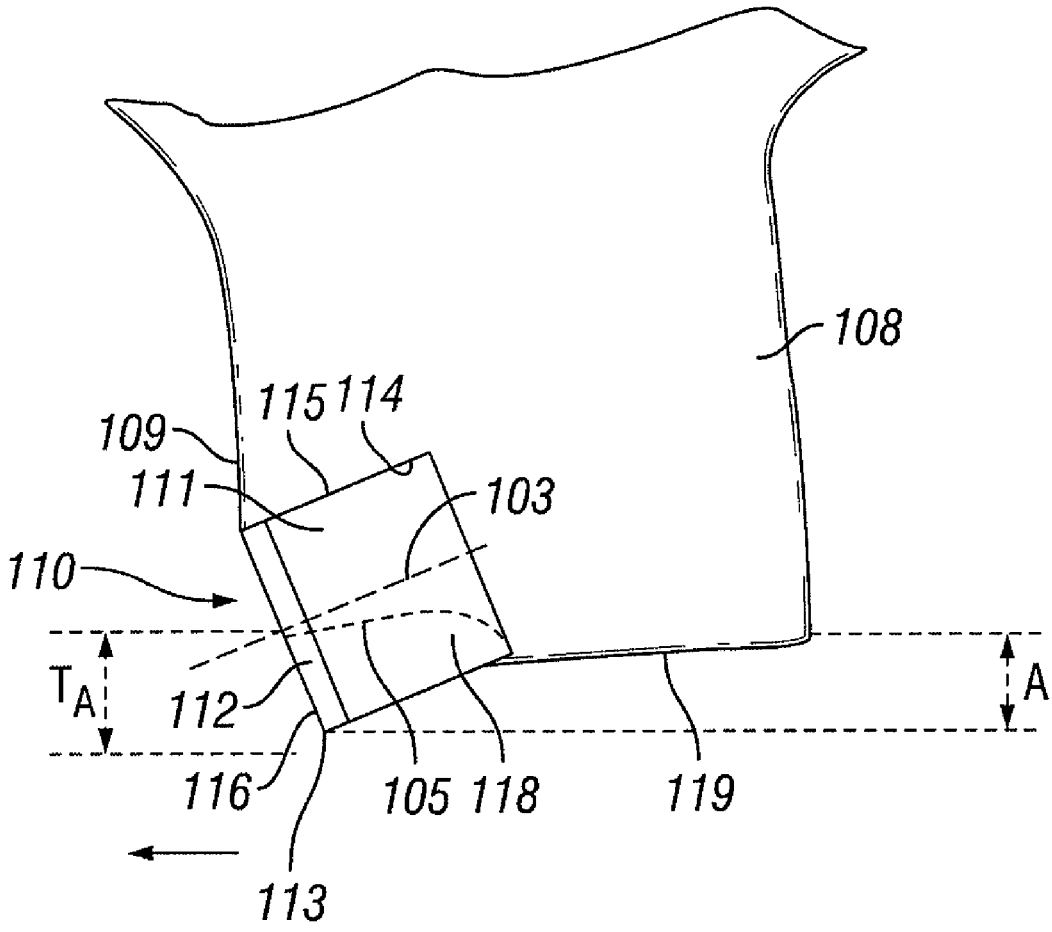
FIG. 2 (Prior Art)
FIG. 2 shows a partial cross-sectional view of a blade of a fixed cutter drill bit having a conventional circular cutter affixed in a socket formed in the leading edge of the blade.

FIG. 2 shows a partial cross-sectional view of one of the blades 108 with a cutter 110 mounted thereon. The blade 108 is shown extending downward on the bit body toward a borehole bottom (not shown). The cutter 110 is brazed or otherwise attached to the cutter socket 114 formed at leading edge 109 of the blade 108. The socket 114 is formed tilted upward toward the trailing end to provide a negative back rake to the cutter 110 for heel clearance between the rock being drilled and a top surface 119 of the blade 108. The cutting face 112 of the cutter 110 extends outward from the blade 108 and is arranged generally transverse to a direction of bit rotation so that it will cut through earth formation as the bit is rotated. An interface formed between the ultrahard material 116 and the substrate 118 may be planar or non-planar in form and one or more layers of transition material may be disposed between the ultrahard material 116 and the material forming the substrate 118 as known in the art.

The cutter 110 is positioned such that the cutter socket 114 envelops the cutter body a small increment past the cutter's centerline 103 (as indicated by dashed line 105). The remaining portion of the cutter extends from the blade top surface 119 and provides in a cutter extension "A" between the blade top surface 119 and the tip 113 of the cutter 110.

In many applications the life of the bit is limited based on the amount of ultrahard material on the cutters extending beyond the blade top surface for drilling and wear. Thus, bit life may be increased by increasing the amount of ultrahard material extending from the blades. In the example in FIG. 2, the amount of ultrahard material available for wear is less than one half of the cutting face, because the other half of the cutter's surface is brazed into the socket formed in the bit body.

In applications where cutters become exposed to high impact loads, bit life may often be shortened because of cutter breakage and/or cutter loss. Cutter loss occurs when the bond strength between a cutter and the bit body is insufficient to handle the loading placed on the cutter. Bond strength can be increased by increasing the interface area provided between the cutter and the bit body. This interface area will be referred to as a "braze area" and the bond strength will be referred to as a "braze strength." However, it should be understood that these terms are intended as generally referring to the interface area and the bond strength between a cutter and bit body whether the cutter is brazed or press-fit into the bit body.

In the example in FIG. 2, the braze area between the cutter 110 and cutter socket 114 is limited to an area that is only slightly more than one-half of the cylindrical side surface 115 of the cutter body. In applications where this limited braze may often fail due to impact and tensile stresses encountered during drilling, the cutter may be embedded deeper into the blade surface to increased the braze area for increased braze strength. However, this will result in a reduction in cutter extension.

Aspects of the Present Invention

In accordance with one aspect of the present invention an improved cutter having an oblong geometry may be used to provide increased bit life for a fixed cutter drill bit. The improved cutter includes a cutting face which is generally centered with respect to a base portion of the cutter and has a major dimension "L" in a first direction and a minor dimension "W" in a perpendicular direction which is smaller than L. The larger dimension L allows for increased cutter extension and ultrahard material for wear during drilling while the smaller minor dimension W permits the packing of more cutter along a given profile. In accordance with another aspect of the present invention, a bit is provided with at least one improved oblong cutter in accordance with the description above to provide increased bit life. The present invention also includes methods for manufacturing improved oblong cutters and bits incorporating the same.

Improved Oblong Cutters

Figure 3:
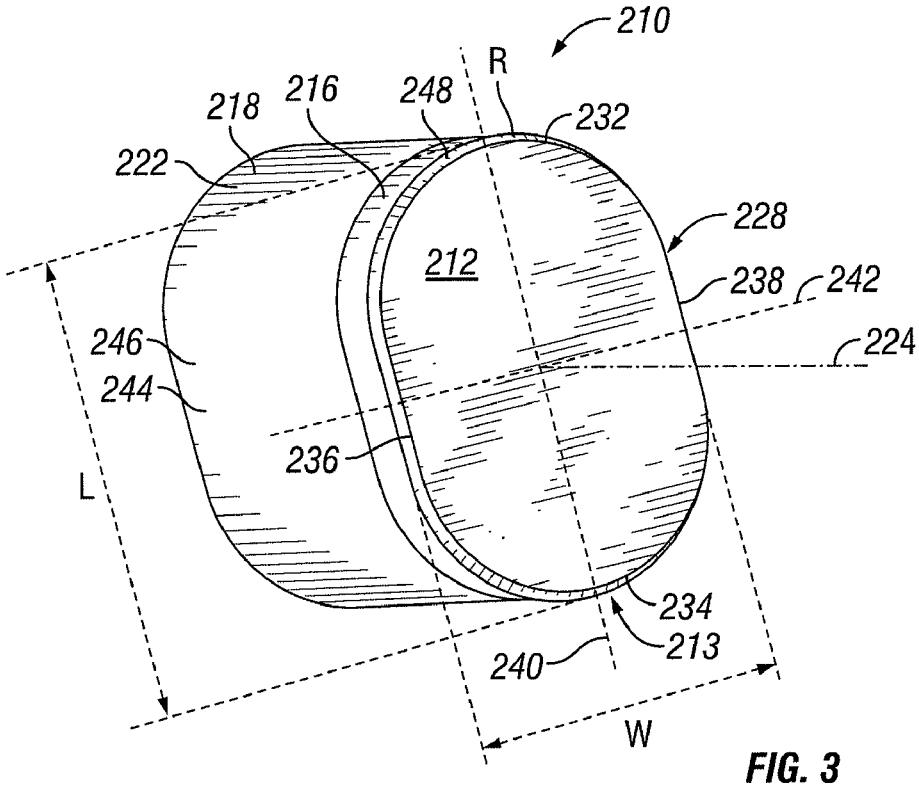
FIG. 3 shows a perspective view of an improved oblong cutter in accordance with one embodiment of the present invention.

One example of an improved cutter in accordance with an aspect of the present invention is shown in FIG. 3. The cutter 210 includes a base portion 222 with a longitudinal axis 224 that extends through a center of the base portion 222 and a cutting face 212 disposed on an end opposite the base portion 222, generally centered with respect to the base portion 222 such that the longitudinal axis 224 extends through or proximal a center of the cutting face 212. The cutting face 212 comprises a cross-sectional geometry which is oblong in form. A periphery edge 228 of the cutting face 212 may be described as comprising a first arcuate segment 232 arranged opposite and spaced apart from a second arcuate segment 234 with linear segments 236, 238 extending on opposite sides there between joining the first and second arcuate segments 232, 234. The cutting face 212 as shown in FIG. 3 spans a largest edge-to-edge dimension, L, in a first direction that intersects the first and second arcuate segments 232, 234. The cutting face 212 spans a largest edge-to-edge dimension, W, in a second direction perpendicular to the first direction, wherein W is smaller than L.

The term "linear segment" is used to refer to a periphery edge segment of the cutting face that is straight or generally ties along a straight path when viewed in a cutting face plane (a plane generally parallel to the cutting face 212). In the case of a cutter with a cutting face generally perpendicular to the longitudinal axis of the base portion, such as the one show, the cutting face plane will be a plane generally perpendicular to the longitudinal axis 224 of the cutter.

The term "major dimension" will be used herein to refer to a largest cutting face edge-to-edge dimension L, and the term "major axis" will be used to refer to an axis along this largest edge-to-edge dimension. The term "minor dimension" will be used to refer to a largest edge-to-edge dimension in a direction perpendicular to the major axis, and the term "minor axis" will be used to refer to an axis perpendicular to the major axis and aligned with the minor dimension. The major axis and minor axis of the cutter 212 shown in FIG. 3 are designated as 240 and 242, respectively.

Those skilled in the art will appreciate that values for the major dimension L and minor dimension W can be selected as desired for a given application. For example, in one embodiment, L may range between 6 mm and about 25 mm, and W may range between 4 mm and 19 mm. Improved oblong cutters in accordance with the present invention may be particularly useful for PDC bits run on positive displacement motors (PDM) or turbines which are often subject to severe wear during drilling and typically result in cutter wear beyond T4 (50% of the cutting face), as indicated in FIG. 2.

In the example embodiment shown in FIG. 3 the first and second arcuate segments 232, 234 of the cutter 210 are in the form of semi-circular arcs with the same radius of curvature R which is equal to W/2 (the radius of a fully round cutter with a diameter W). The semi-circular arcs form opposite ends of the cutting face 212 with their centers aligned along the major axis 240. The first linear segment 236 extends between an end of the first arcuate segment 232 and an end of the second arcuate segment 234 to form a first side of the cutting face 212. The second linear segment 238 extends between the other ends of the first and second arcuate segments 232, 234 to form a second side of the cutting face 212 opposite the first side. The first and second linear segments 236, 238 join with the arcs at a point tangent to their arcuate surfaces which provides a smooth transition between arcuate segments 232, 234 and linear segments 236, 238. The linear segments 236, 238 are generally parallel, generally the same in length, and correspond to diametrically opposed flats 246 formed along opposite sides of the cutter 210.

In the example shown in FIG. 3, the cutter 210 has a transverse cross-section which is substantially constant along its length such that the outer periphery of the base portion 222 is substantially the same in form and dimension as that of the cutting face 212 and can be similarly described along with lateral side walls 244 that extend between the base portion 222 and the cutting face 212. In this embodiment, the cutter 210 is symmetrical with respect to a plane defined by the longitudinal axis 224 and the minor axis 242. This symmetrical geometry allows the base portion 222 of the cutter 210 to engage in a cutter socket of corresponding shape in more than one orientation, namely, a first orientation and a second orientation rotated 180° about the longitudinal axis 224 from the first orientation. This permits rotation of the cutter in the cutter socket after one side of its edge has been worn during drilling to expose a diametrically opposed cutting edge for use in a second drilling run, if desired. A cutter that can be rotated and reused for a subsequent drilling run will be referred to as a "rotatable cutter". Rotatable cutters can be used in bit designs to provide a cost savings benefit in rebuild operations because cutters may be reused for a subsequent drilling run before being scraped.

The cutter 210 also includes a chamfer or radius along at least a portion of its periphery cutting edge 228, such as along the portion forming the cutting tip 213. In the example shown a chamfer 248 is provided around the entire periphery edge 228 of the cutting face 212. Additionally, the interface formed between the substrate 218 and layer of ultrahard material 216 may be planar or non-planar in form and/or may include one or more layers of transition material (not shown) between the ultrahard material layer and substrate material as is known in the art.

Figure 4:
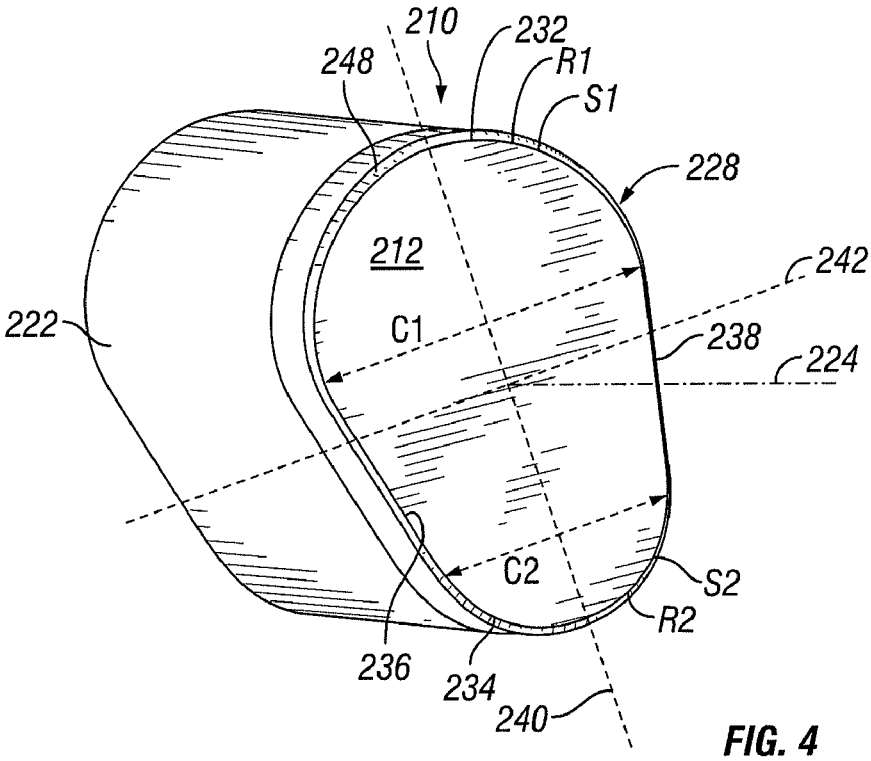
FIG. 4 shows a perspective view of an improved oblong cutter in accordance with another embodiment of the present invention.

Another embodiment of a cutter in accordance with an aspect of the present invention is shown in FIG. 4. The cutter 210 includes a base portion 222 with a longitudinal axis 224 and a cutting face 212 on an end opposite the base portion 222, generally centered with the base portion 222 such that the longitudinal axis 224 extends through or proximal a center thereof. The cutting face 212 has a cross-sectional geometry that is oblong in form with a periphery edge 228 comprising a first arcuate segment 232 arranged opposite and spaced apart from a second arcuate segment 234 with linear segments 236, 238 extending there between joining the first and second arcuate segments 232, 234. The cutting face 212 spans a largest edge-to-edge dimension, L, in a first direction intercepting the first and second arcuate segments 232, 234 and a largest edge-to-edge dimension, W in a perpendicular direction which is smaller than L.

In this example, the radius of curvature $R_1$ and arc length $S_1$ of the first arcuate segment 232 are larger than the radius of curvature $R_2$ and arc length $S_2$ of the second arcuate segment 234. Thus, the first arcuate segment 232 has an end-to-end chord length $C_1$ that is larger than the end-to-end chord length $C_2$ of the second arcuate segment 234. The first and second linear segments 236, 238 that extend on opposite sides between the first and second arcuate segments 232, 234 are sloped at angles with respect to the major axis 240 which produces a tapered cutting face geometry that tapers in a direction from the first arcuate segment 232 to the second arcuate segment 234. This cutter geometry permits a the packing of more cutters along a given bit profile, which may be desired in applications, such as highly abrasive applications, to further increase the ultrahard material volume provided on the bit for increased bit life. When mounted on a bit this cutter geometry can be described as fanning out as it extends away from the bit body surface. In this case, the arcuate segments and linear segments join at tangents for a smooth transition around the periphery of the cutter; however this is not considered a limitation on the present invention.

Those skilled in the art will appreciate that embodiments of the present invention are not limited to the examples above but rather numerous other embodiments may be configured in accordance with the present invention. For example, in other embodiments the radii of curvature for the first and second arcuate segments may be different and may vary along one or both of the arcuate lengths. The chord length spanned by each arcuate segment may also be different. Also, linear segments forming opposite sides of the cutting face not be parallel and may differ in length. Additionally, in one or more embodiments, more than one linear segment may be positioned along one or both sides of the cutting face between the arcuate segments. Furthermore, in other embodiments the cutter may comprise a transverse cross-section that varies along its length. For example, in one embodiment a cutter may comprise a cross-sectional geometry that increases in area in a direction from the base portion toward the cutting face. Additionally, in other embodiments the cutting face of the cutter may be contoured in form rather than flat, for example as disclosed in U.S. Patent Publication No. 20050247492 A1 which is assigned to the assignee of the present invention and incorporated herein by reference. Other embodiments may also include a cutting face that is canted at an angle with respect to the longitudinal axis through the base portion rather than generally perpendicular to the longitudinal axis. However, it is expected that the cutting face will still be generally centered with respect to the base portion.

Those skilled in the art will appreciate that in one or more embodiments, a desired radius of curvature for an arcuate segment forming a cutting tip may be less than or equal to L/2 (the radius of a fully round cutter having a diameter L), depending on the particular drilling application. A radius of curvature smaller than L/2 may be used at the cutting tip to produce a sharper or more aggressive cutter that can achieve a higher rate of penetration (ROP) than a conventional cutter of equivalent extension. In particular applications, a desired radius of curvature at the cutting tip may be greater than or equal to W/2 (the radius of a fully round cutter having a diameter W) to provide a cutting tip that is more resistant to impact fracture. In preferred embodiments, the radius of curvature at the cutting tip will be greater than $W^2/(2L)$ (the radius of curvature provided at the narrow tip of an ellipse having a major diameter L and a minor diameter W) to provide a tougher cutter which is less susceptible to impact failure to avoid premature cutter failure.

In one example, a cutter similar to that shown in FIG. 3 may be formed to have major dimension L equal to 19 mm, a minor dimension W equal to 13 mm, and a radii of curvature R equal to around 6.5 mm (equivalent to a fully round 13 mm cutter) along the first and second arcuate segments 232, 234. The resulting cutter will permit a higher ROP than a conventional 19 mm cutter under a similar loading condition and will be tougher than a conventional 13 mm cutter because of its larger cross-sectional area which means that the stress at the interface will be reduced under similar loading.

Improved Drill Bits

Figure 5:
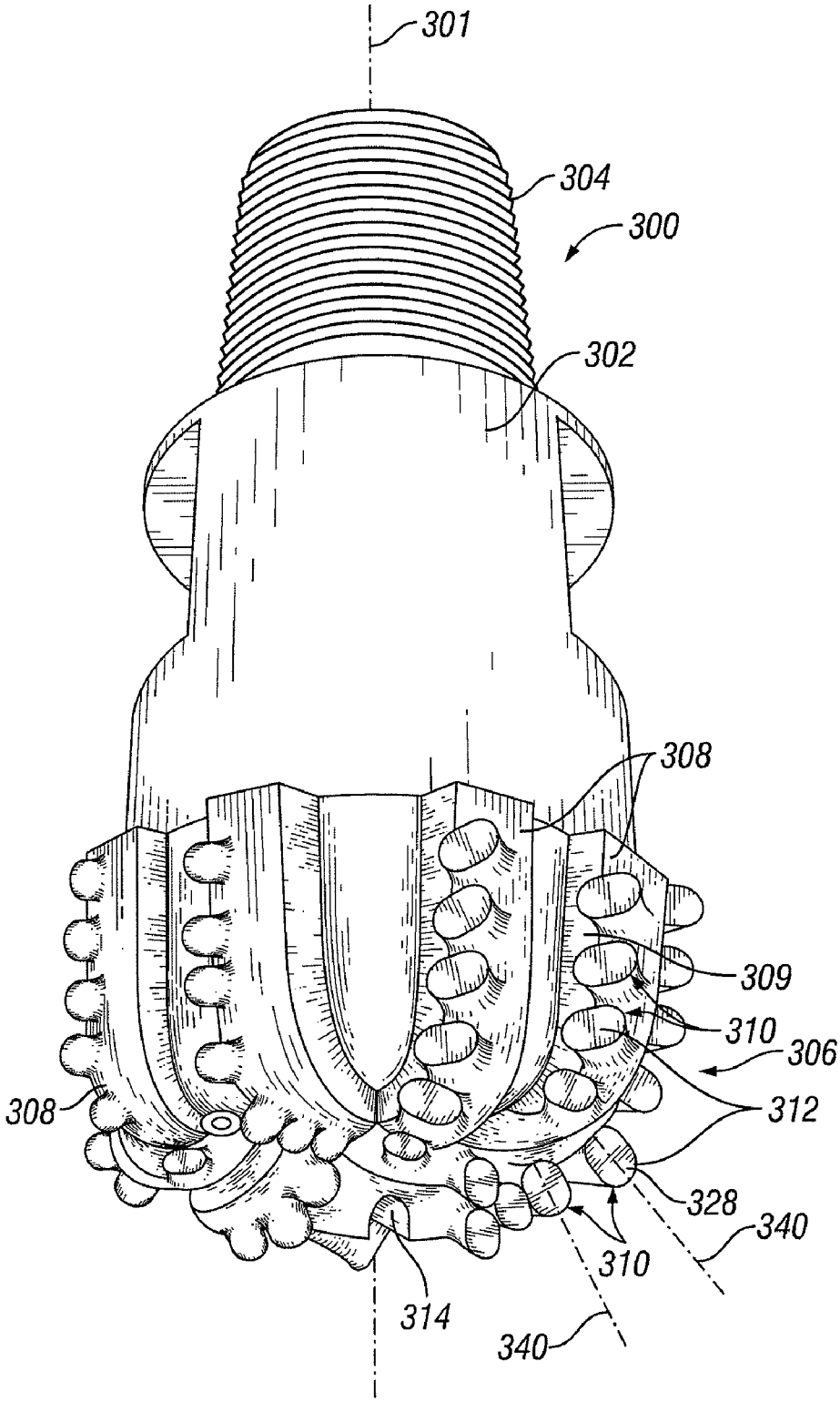
FIG. 5 shows one embodiment of a fixed cutter drill bit having improved oblong cutters in accordance with an embodiment of the present invention.

A drill bit in accordance with another aspect of the present invention is shown for example in FIG. 5. The bit 300 includes a bit body 302 with a threaded connection at a first end 304 for connecting to a drill string and cutting structure disposed at a second end 306 for cutting through earth formation. The cutting structure includes a plurality of blades 308 extending generally radially outwardly away from a central longitudinal axis 301 of the bit at the second end 306. A plurality of improved oblong cutters 310 in accordance with an aspect of the present invention are mounted in sockets 314 formed in the blades 308 with their major axes 340 projecting generally outward from the bit body 302.

Figure 6:
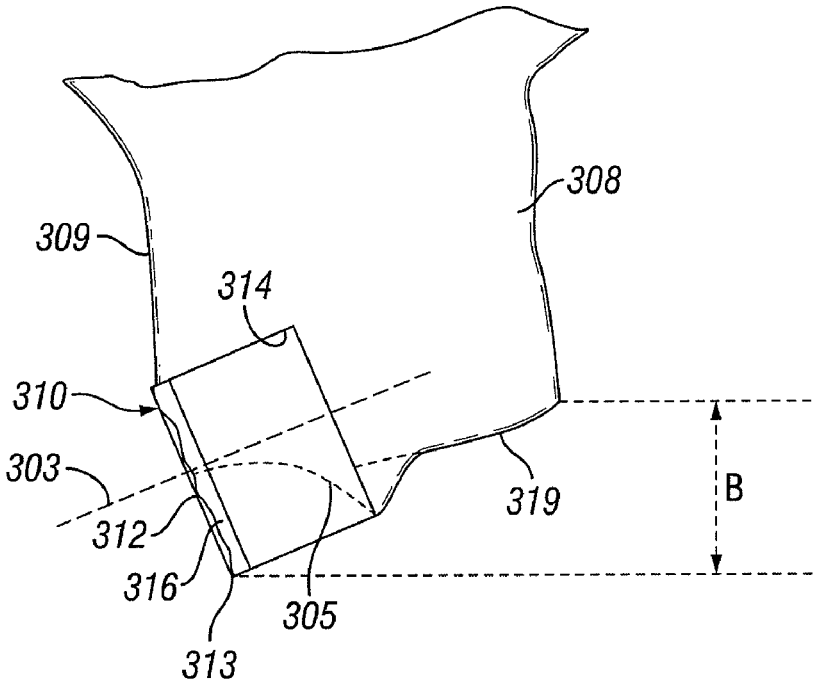
FIG. 6 shows a partial cross-sectional view of a blade of a fixed cutter drill bit having an improved oblong cutter affixed in a socket formed in the leading edge of the blade in accordance with an embodiment of the present invention.

FIG. 6 shows a partial cross-sectional view of one of the blades 308 having a cutter 310 in accordance with the present invention mounted therein. The blade 308 extends downward from the bit (300 in FIG. 4) toward a borehole bottom (not shown). The improved oblong cutter 310 is shown brazed into a socket 314 of corresponding shape formed at the leading edge 309 of the blade 308. The cutter socket 314 is tilted upward toward the trailing end to provide a negative back rake to the cutter 310 for heel clearance. The cutter 310 has a cutting face 312 which extends outward and downward from the leading edge 309 of the blade 308 so that it can cut through formation as the bit is rotated. The cutter socket 314 envelops the body of the cutter 310 a small increment past the cutter's centerline 303 (as indicated by dashed line 305). The remaining portion of the cutter 310 extends from the blade top 319 to provide a cutter extension "B" between the blade top 319 and cutting tip 313. This cutter extension "B" is greater than the cutter extension provided by a conventional circular cutter of equivalent width. This increase in cutter extension provides increased clearance for drilling fluid to flow pass and cool and clean the cutter 310 during drilling and provides increased ultrahard material volume at the cutting face 312 for prolonged drilling and wear life.

Figure 7A:
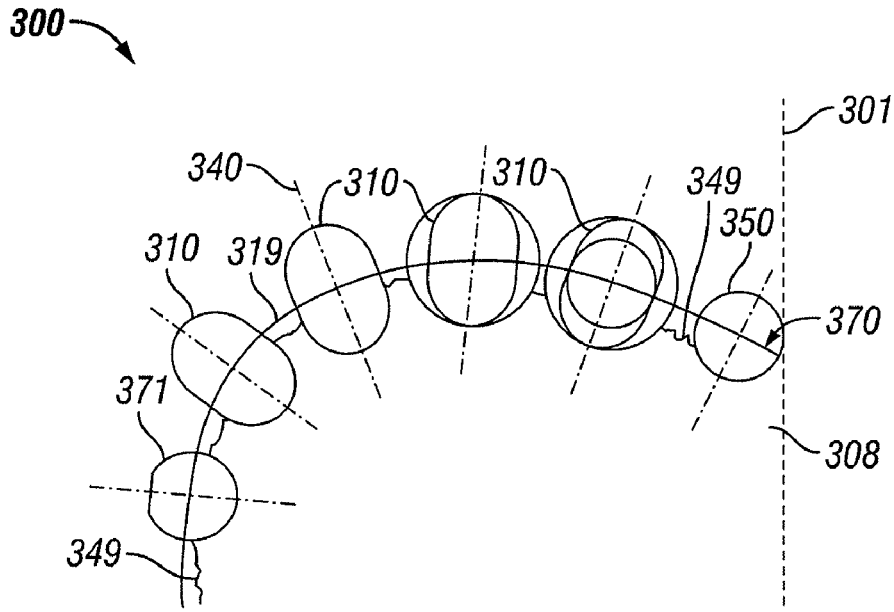
FIGS. 7A-7C show examples of different partial profile views of blades on a fixed cutter bit that have improved oblong cutters mounted thereon in accordance with aspects of the present invention.

FIG. 7A shows one example of a partial profile view of a blade 308 of a bit in accordance with one aspect of the present invention. In this example, the improved oblong cutters 310 are shown mounted on the blade 308 with their major axes 340 projecting outward from the bit body in a direction generally normal to the bit profile 370. Conventional round cutters 350 and pre-flat cutters 371 are also shown mounted on the blade at selected locations.

In addition to offering increased cutting extension and extending wear life for the bit, improved oblong cutters 310 in accordance with the present invention may also be used to provide prolong cutter retention during drilling. In particular, in many abrasive and erosive applications, blade material is often eroded or otherwise worn away from around the cutters during drilling (as indicated by wear line 349). In these applications a bit may often fail prematurely due to cutter loss because of insufficient braze strength or interface area remaining between the cutters and cutter sockets to retain the cutters in place during drilling. Using improved oblong cutters in accordance with the present invention, the interference area between a cutter 310 and cutter socket 314 may be increased without sacrificing cutter extension, as shown for example in FIG. 7A. This permits an increase in braze strength between the cutter and cutter socket which can result in prolonged cutter retention and bit life during drilling.

In accordance with another aspect of the present invention, cutters having major and minor cutting face dimensions can be mounted on the bit in an optimized orientation for maximized wear and bit life. This aspect of the invention can be applied to a bit having any type of cutters with major and minor cutting face dimensions, such as a bit including one or more elliptical cutters, asymmetrical cutters, and/or improved oblong cutters. In accordance with this aspect of the present invention, the cutters are preferable mounted on the bit in a selected orientation such that their major axes project outward from the bit body in a direction corresponding to a maximum load or wear rate expected on the cutter, or in a direction normal to an expected wear flat.

Considering, for example, a bit having cutters arranged on the blades in a forward or backward spiral distribution, wherein each cutter increases in radial distance from blade to blade as you move in an outward spiral pattern, clockwise or counter clockwise, around the bit axis. Forward and backward spiral distributions are well known in the art. Cutters placed on a bit in this type of arrangement typically swept a path that partly overlaps with a path swept by a cutter on a proceeding and/or trailing blade that is positioned at a slightly greater and/or smaller radial distance from the bit axis. Cutters arranged in a forward or backward spiral distribution have a maximum load direction that typically shifts away from a line normal to the bit profile. In accordance with one aspect of the present invention, cutters having major and minor cutting face dimensions and placed this type of configuration can be mounted on the bit so that their major axes project outward from the bit body in direction inclined at an angle with respect to a line normal to the bit profile so that their major axes are generally aligned to correspond to a direction of the maximum load or wear rate expected on the cutter to provide prolonged wear life for the cutters and bit. The direction of the maximum load or wear rate on a cutter may be determined from a dynamic simulation of a bit using any method known in the art, such as one disclosed, for example, in U.S. Patent Publications 2005/0096847A1, 2005/0080595A1, 2005/0133272A1, and/or 2005/015229A1, which are assigned to the assignee of the present invention and incorporated herein by reference. Alternatively, the direction of maximum load or wear rate on a cutter may be determined from examination of dull bits, analysis of the amount of overlap between adjacent cutters, or other methods known in the art for determining expected loads or wear on cutters and the orientation of the cutters adjusted to better align the major axis of the cutting face along the expected direction.

Figure 7B:
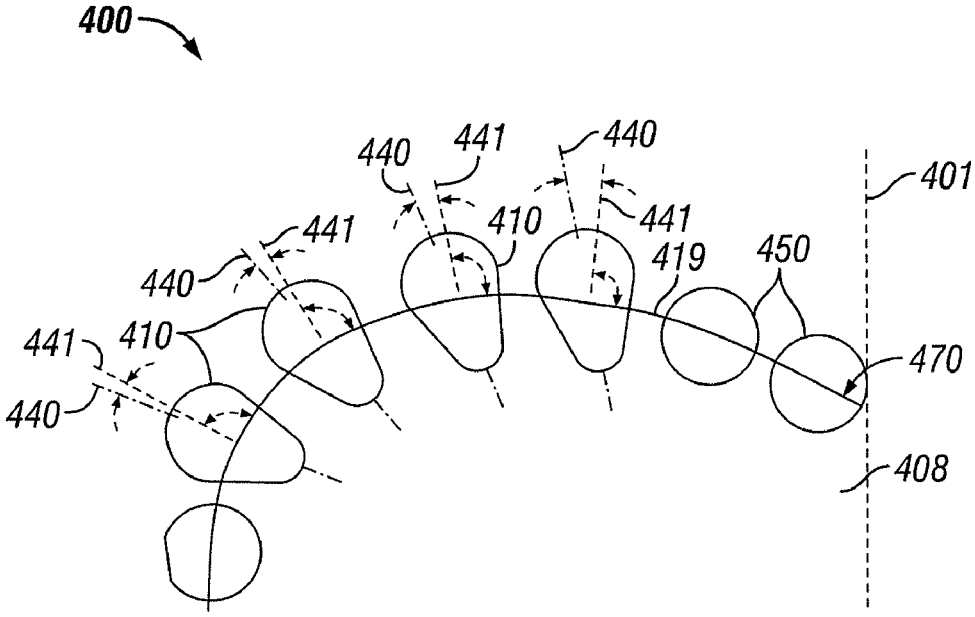

FIG. 7B shows one example of a partial profile view of a blade 408 of a fixed cutter bit that comprises cutters 410 similar to that shown in FIG. 4 mounted in a forward spiral distribution. In accordance with the above aspect of the present invention, the cutters 410 are mounted on the blade 408 with their major axes 440 projecting outward from the surface 419 of the bit body in a direction that is rotated radially outward from the bit axis 401 relative to a line 441 drawn normal to the bit profile 470 so that they generally correspond to a maximum load or wear rate direction expected on the cutter.

Figure 7C:
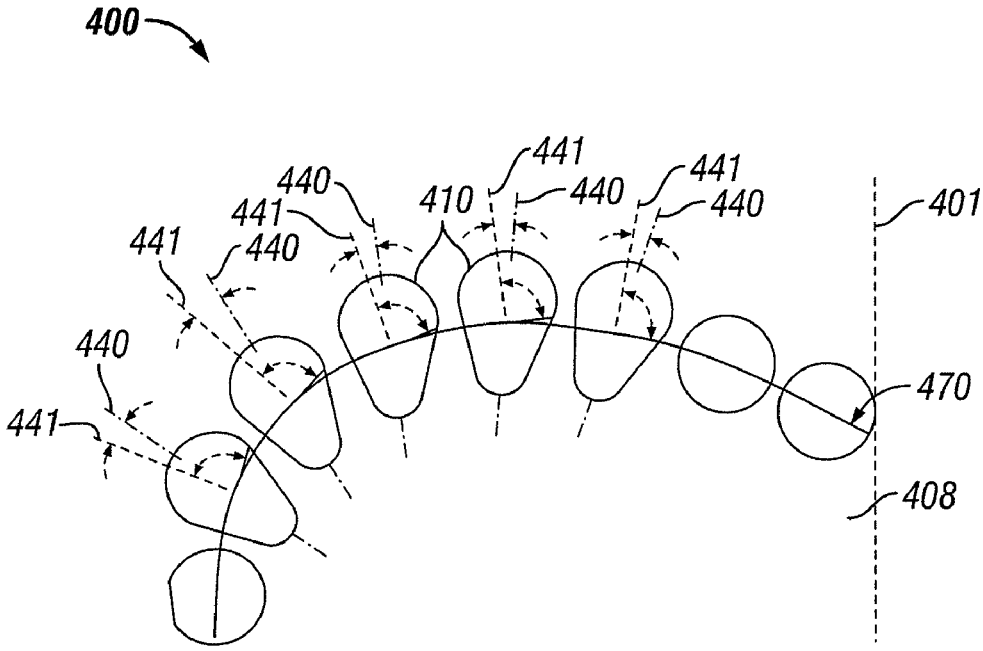

FIG. 7C shows another example of a partial profile view of a blade 408 of a fixed cutter bit that comprises cutters 410 mounted in a backwards spiral distribution. In this example, the cutters are mounted on the blade 408 with their major axes 440 projecting outward from the bit surface 419 in a direction that is rotated inward toward the bit axis 401 relative to a line 441 drawn normal to the bit profile 470.

In one or more preferred embodiments, cutters arranged on a bit in a forward or backward spiral distribution which include major and minor cutting face dimensions may be positioned such that their major axes project outward from the bit at an angle of 1° to 15° from a line normal to the bit profile, depending on the amount of helix provided between the cutters. Cutters having major axes projecting outward from the bit body along a direction generally aligned with a direction of maximum load or wear rate, advantageously, can result in wear flats being formed on the cutters normal to their major dimensions for prolong cutter wear and bit life. This also results in normal forces being applied along the longer cutting face direction, which can lead to prolong drilling life of the cutter and bit.

Comparison with Prior Art

Figure 8:
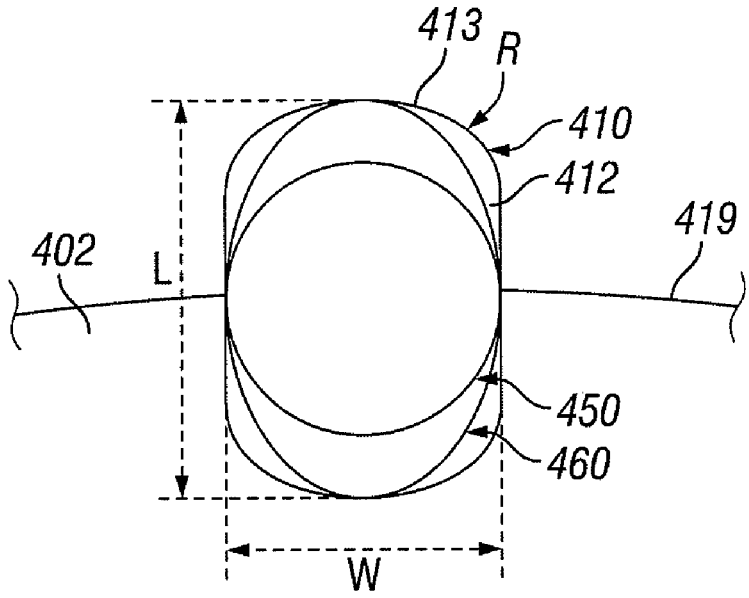
FIG. 8 shows a cutting face view of a cutter in accordance with the present invention mounted on a bit with the geometry of a conventional circular cutter and an elliptical cutter of similar dimension superimposed on its cutting face for comparative purposes.

For comparative purposes, an enlarged partial profile view of the improved oblong cutter 410 in FIG. 3 is shown in FIG. 8 mounted on a bit with one half of its cutting face 412 extending above the bit body 402. A conventional, circular cutter 450 of equivalent width (diameter of W) and an elliptical cutter 460 of equivalent dimensions (major diameter of L and a minor diameter of W) are shown projected on the cutting face 412. As can be seen from the given example, the improved oblong cutter 410 provides greater cutter extension from the bit body surface 419 than the conventional circular cutter 450 and a larger cutting face surface area than both the circular cutter 450 and the elliptical cutter 460. The term "workable surface area" will be used to refer to the portion of cutting face surface area that extends above the surface 419 of the bit body 402. The term "workable ultrahard volume" will be used to refer to the volume of ultrahard material at the cutting face that extends above the bit body surface 419 for drilling and wear. Referring to FIG. 8, each cutter 410, 450, and 460 has a workable surface area that is equal to about one half of its cutting face surface area. For dimensions of L=19 mm, W=13 mm, and R=6.5 mm and an assumption of flat cutting faces, the circular cutter 450 will have a cutting face surface area of about 133 $mm^2$ (0.206 $in^2$) and a workable surface area of about 66 $mm^2$ (0.103 $in^2$). The elliptical cutter 460 will have a cutting face surface area of about 194 $mm^2$ (0.301 $in^2$) and a workable surface area of about 97 $mm^2$ (0.150 $in^2$). The improved oblong cutter 410 will have a workable surface area of about 211 $mm^2$ (0.327 $in^2$) and a workable surface area of about 105 $mm^2$ (0.163 $in^2$). Assuming equivalent ultrahard layer thickness, the improved oblong cutter 410 will provide about 60% more surface area and workable ultrahard volume than the conventional circular cutter 450, and about 10% more surface area and workable ultrahard volume than the elliptical cutter 460. This increase in ultrahard volume, advantageously, can result in an increase in the wear life of the cutter 410 and the drilling life of the bit.

The improved oblong cutter 410 in FIG. 8 also, advantageously, includes a broader cutting tip 413 than provided by an elliptical cutter 460 of equivalent dimensions. Therefore, the improved oblong cutter 410 also will be more fracture resistant than an equivalent elliptical cutter 460 and, thus, more suitable for use in harder formations and higher speed drilling applications. Providing a broader cutting tip may lead to a significant increase in the life of the cutter and bits used in these types of applications.

The improved oblong cutter 410 also includes a larger interface surface between the substrate (not shown) and ultrahard layer forming the cutting face 412 than both the circular cutter 450 and elliptical cutter 460. This permits greater retention of the ultrahard layer on the substrate, and is particularly beneficial in embodiments wherein the cutting face 412 comprising a fully thermally stable polycrystalline diamond body bonded to the substrate via a conventional method, such as vacuum brazing, microwave brazing, or the like. For embodiments comprising an ultrahard layer formed integral with the substrate, such as through sintering or the like, the increase in the interface surface area permits the use of an ultrahard layer of greater thickness without increasing stress related failure of the cutter.

Referring again to FIG. 8, the improved oblong cutter 410 further includes a base portion (not shown) which has an outer periphery geometry that is substantially the same as that of the cutting face 412. Thus, a larger interface area exists between the base portion and cutter socket (not shown) than would exist for the circular cutter 450 or elliptical cutter 460 shown. A larger interface area means a larger braze surface for superior cutter retention in the cutter socket compared to the circular cutter 450 and the elliptical cutter 460. This will allow for longer retention of the cutter in the cutter socket during drilling when material is eroded from around the cutters. For example, referring to FIG. 7A, an improved oblong cutter in accordance with the present invention may have a resulting braze area that is around twice that of a conventional cutter of similar width and around 20% larger than that of an elliptical cutter of similar dimensions. In one embodiment, a cutter in accordance with an aspect of the present invention may have a major dimension of 19 mm, a minor dimension of 13 mm, and a resulting cutter extension greater than or equal to 9 mm with one-half of the cutter body surface embedded in blade material for superior retention. In other embodiments, a cutter in accordance with an aspect of the present invention may be mounted on a bit and configured to provide any amount of cuter exposure desired for the given application.

In one or more embodiments, the cutter may have an symmetrical base potion, such as shown for the example in FIG. 3, wherein the base geometry permits mounting of the cutter in a cutter socket of corresponding geometry in a first orientation and in a second orientation rotated 180° about the longitudinal axis from the first orientation. This provides a rotatable cutter which can be removed from a bit after one side of its cutting edge is worn and then repositioned in a socket at an orientation rotated 180° from the first orientation so the diametrically opposed side of the cutting edge can be use for drilling in a subsequent drilling run.

Methods for Manufacturing Cutters

Figure 9:
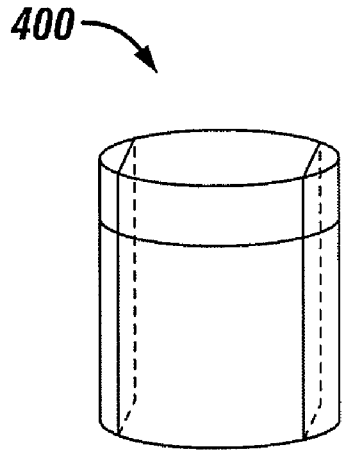
FIG. 9 shows an example of how an improved oblong cutter may be formed using a conventional circular cutter.

Cutters in accordance with the present invention may be formed using any method known in the art. For example, compacts can be formed to have an "as pressed" geometry by placing substrate material and ultrahard material in a shaped canister having a cross-sectional geometry similar in form to the final geometry desired for the cutter. The canister can then be subjected to high temperature and high pressure conditions sufficient to bond the ultrahard material particles together and to bond the ultrahard material to the substrate. The canister can then be removed from the outer surface of the compact and the compact ground to final size and dimensions desired for the cutter. Additionally, cutters may be formed from conventional circular compacts by machining diametrically opposed flats on opposite sides of the cutter to reduce the transverse dimension there between. For example, a cutter with a geometry similar to that shown in FIG. 3 or 4, can be cut from a circular compact having a diameter L by cutting flats along opposed sides of the cutter, transverse to the cutting face, to reduce a transverse dimension there between. As illustrated in FIG. 9, for example, a cutter having a major dimension of 19 mm and a minor dimension of 13 mm can be cut from a 19 mm circular cutter by EDM cutting a first flat on a first side of the cutter transverse to the cutting face and then EDM cutting a second flat along a second side of the cutter, opposite the first side. The flats may be formed by cutting along opposed chords spaced 6.5 mm from a center of the cutter in a direction transverse to the cutting face. It should be appreciated that while the lateral side surfaces of the cutter are generally referred to as flats, in one or more embodiments they may actually be slightly convex or concave in form due to the shape of the machining tool used and/or other factors.

Cutters in accordance with one or more embodiments of the present invention include a cutting face minor dimension which may permit a closer spacing of cutting tips, if desired, for increased diamond protection and coverage for a bit. Alternatively, cutters in accordance with the present invention may be used to advantageously eliminate thin, weak spots of bit body material between adjacent cutters while still allowing a relatively large number of cutters per row. Providing cutters with flats also provide a means whereby cutters may be properly indexed or positioned in a cutter socket. Proposed geometries also minimize tolerance control problems associated with fitting elliptical cutters in elliptical sockets as proposed in prior art. Additionally, cutters in accordance with one or more embodiments of the present invention can be manufactured as described in examples above relatively easily and inexpensively as compared to previously proposed designs, and can be formed with closer dimensional tolerances in that it is a fairly simple matter to machine flats to close tolerances.

Cutters in accordance with the present invention may comprise any ultrahard material known in the art for forming a portion or an entire cutting face of a cutter, including polycrystalline diamond, cubic boron nitride, and composites or mixtures thereof. In the case of polycrystalline diamond (PCD) material, the PCD body may be treated to render it partially or completely thermally stable for enhance abrasion resistance. This can be done, for example, by removing substantially all of the solvent metal catalyst from a region or the entire PCD body using a suitable process, such as acid leaching, aqua regia bath, electrolytic process, or combinations thereof. Examples of acid leaching processes that can be used are described, for example, in U.S. Pat. Nos. 4,224,380, 4,572,722 and 4,797,241. Alternatively, rather than removing the solvent metal catalyst, a region or all of the PCD body may be rendered thermally stable by treating the solvent metal catalyst in a manner that renders it unable to adversely impact the PCD body at elevated temperatures, such as temperatures between 700 and 900° C. Alternatively, a thermally stable diamond body may be formed using silicon as the catalyst material. In the case of fully thermally stable diamond bodies, the diamond body may be affixed to a substrate by a sintering or brazing as is well known in the art. Examples of brazing techniques are disclosed in U.S. Pat. No. 6,315,066 to Dennis or WO9929465A1 or WO0034001A1 to Radtke.

Examples of Bit Manufacturing

Bits in accordance with embodiments of the present invention may be formed to include corresponding sockets for cutters using any conventional manner known in the art. For example, a metal matrix bit body may be formed by filing a bit head mold with metal tungsten carbide particles and infiltrating with a binder material to form a hard cast metal matrix bit body. In such case, pocket formers or cutter receptacles may be included or placed in the mold prior to filling the mold with matrix powder so that the infiltrated body subsequently formed in the mold will includes the sockets formed therein which are sized and shaped as desired to receive a corresponding plurality of cutters. Alternatively, the bit body may be machined from a steel block as is known in the art, wherein the desired sockets are machined into the bit body. Alternatively, the bit body may be formed through investment casting techniques or other techniques known in the art.

Bits in accordance with embodiments of the present invention may also include other various surface features, such as raised blades, gage pads, back reaming features, fluid ports, fluid passageways, and junk slots, as is known in the art. The number, size, and configuration of the blades, cutters, and/or other bit features typically will be selected based on the type of rock to be drilled, and thus can be varied to meet particular rock drilling requirements as desired. Examples of bit manufacturing methods are further described, for example, in U.S. Pat. Nos. 5,662,183 to Fang, 5,765,095 to Flak et al., 6,353,771 to Southland and 6,287,360 and 6,461,401 to Kembaiyan et al.

In accordance with one or more embodiments, a bit may be formed to include at least one socket formed therein comprising an internal cross-sectional geometry comprising a first arcuate segment and a second arcuate segment which are spaced apart and arranged opposite each other with linear side segments disposed there between joining the first and second arcuate segments. The socket opening can be said to span a maximum edge-to-edge dimension L, in a first direction that intersects the first and second arcuate segments and a maximum edge-to-edge width $W_s$ in a second direction transverse to the first direction which is smaller than $L_s$. Once the body is formed, cutters can are mounted in the sockets and affixed thereto by any suitable method, such as brazing, interference fit, or the like.

Other Advantages & Benefits

Bits having cutters in accordance with one or more embodiments of the present invention may, advantageous, require a lower weight on bit to maintain constant loading on the cutting face as compared to a bit having conventional circular cutters because the width of the wear flat on the cutter is not ever-increasing like that of a circular cutter. Bits with cutters in accordance with one or more embodiments of the present invention may also include greater amount of ultrahard cutting surface available for drilling as compared to a bit with circular or elliptical cutters of equivalent dimension. This may be achieved, for example, due to a closer spacing of the cutters on the bit and/or greater exposure of the individual cutters to the earth formation being drilled. Additionally, cutters in accordance with one or more embodiments of the present invention may have larger surface area exposure for enhanced cooling and cleaning of the cutter during drilling which can reduce thermal degradation of the cutters and extend cutter drilling life. In one or more embodiments, cutters may also be formed to include thermally stable regions at the cutting face for enhanced abrasion and wear resistance to provide maximized drilling life. Such cutters may be particularly useful for highly abrasive or higher speed drilling applications. Cutters in accordance with one or more embodiments of the present invention may also be easier and/or less expensive to manufacture than elliptical cutters and asymmetric cutters previously proposed. Additionally, the resulting bit tolerances will be easier to control and maintain than when using elliptical cutters.

Embodiments of bits may be used in selected applications to provide increased cutter extensions from blade surfaces without sacrificing braze (or bond) strength for the cutters. Cutters advantageously may be configured to provide broader cutting tips than those on elliptical cutters of equivalent dimension, which makes them more suitable for use in harder formation and higher speed drilling applications. Cutter widths may also be selected to permit increased packing of cutters on the bit for increased ultrahard cutting volume and/or increased cutter engagements for improved impact resistance. One or more cutters in accordance with the present invention may be configured to include rotatable base geometries that pen-nit reuse of the cutters after a first side has been worn. The present invention also provides cutter configurations which permit selection of a cutting tip radius independent of the cutter extension height so that both can be optimized for a given drilling application.

A limited number of examples have been provided in the description above wherein numerous specific details have been set forth in order to provide a more thorough understanding of various aspects of the present invention. However, it will be apparent to one of ordinary skill in the art that the invention may be practiced without these specific details. In other instances, well-known features and methods have not been described in detail to avoid obscuring the invention. While the invention has been described with respect to a limited number of embodiments, those skilled in the art, having benefit of this disclosure, will appreciate that other embodiments can be devised which do not depart from the scope of the invention. Accordingly, the scope of the invention should be limited only by the attached claims.

What is claimed is:

1. A cutter for an earth boring fixed cutter drill bit comprising:

a base portion with a longitudinal axis that extends through a center of said base portion; and a planar cutting face disposed on an end opposite said base portion and arranged generally perpendicular to said longitudinal axis, said planar cutting face centered with respect to said base portion such that said longitudinal axis extends through a center of said planar cutting face, wherein said base portion and said planar cutting face have a periphery edge comprising:

a first arcuate edge segment and a second arcuate edge segment spaced apart and arranged opposite each other with linear segments disposed there between joining said first arcuate segment and said second arcuate segment, said base portion and planar cutting face spanning a maximum edge-to-edge dimension L along a first direction corresponding with a major axis of said base portion and planar cutting face which intersects said first and second arcuate segments, and spanning a maximum edge-to-edge dimension W along a second direction perpendicular to said first direction, said base portion and planar cutting face having a minor axis aligned with said second direction, wherein said first arcuate segment comprises a radius of curvature that is greater than a radius of curvature along said second arcuate segment.

2. The cutter of claim 1, wherein at least one of the said first and second arcuate edge segments comprises a radius of curvature substantially constant along its length.

3. The cutter of claim 2, wherein each of said first and second arcuate edge segments comprises a radius of curvature that is substantially constant along its corresponding length.

4. The cutter of claim 1, wherein a radius of curvature along the at least one of said first and second arcuate segments is less than or equal to L/2.

5. The cutter of claim 4, wherein a radius of curvature along at least one of said first and second arcuate segments is greater than or equal to W/2.

6. The cutter of claim 4, wherein the one of said first and second arcuate segments has a radius of curvature greater than (W^2)/(2*L) at a point of greatest extent from the center of said planar cutting face.

7. The cutter of claim 1, wherein one of said first and second arcuate segments comprises an edge length that is greater than the edge length of said other of said first and second arcuate edge segments.

8. The cutter of claim 1, wherein said first arcuate segment spans a greater cord length than said second arcuate segment, and said linear segments joining said first and second arcuate segments incline at an angle with respect to the major axis to form a cutting face geometry that tapers in a direction toward the second arcuate segment.

9. The cutter of claim 1, wherein said linear segments comprise a first linear segment and a second linear segment, said first linear segment disposed on a first side of said planar cutting face between a first pair of ends of said first and second arcuate segments, and said second linear segment being disposed on an opposite side of said planar cutting face between a second pair of ends of said first and second arcuate segments.

10. The cutter of claim 9, wherein said first and second linear segments are arranged generally parallel to each other.

11. The cutter of claim 10, wherein said first and second linear segments correspond to diametrically opposed flats formed along sides of said cutter.

12. The cutter of claim 9, wherein said first and second linear segments are generally the same length.

13. The cutter of claim 1, wherein L is between 6 mm and 25 mm.

14. The cutter of claim 13, wherein W is between 4 mm and 19 mm.

15. The cutter of claim 1, wherein the L is 19 mm and W 13 mm.

16. The cutter of claim 1, wherein a transverse cross-section of said cutter is substantially constant along its axial length.

17. The cutter of claim 1, wherein said planar cutting face includes a chamfer or radius long at least a portion of said periphery edge.

18. The cutter of claim 1, wherein said base portion comprises a peripheral geometry adapted to engage in a receiving socket of corresponding shape in multiple orientations.

19. The cutter of claim 18, wherein said multiple orientations comprise of a first orientation and a second orientation 180° from said first orientation.

20. The cutter of claim 1, wherein said ultrahard material comprises polycrystalline diamond or cubic boron nitride.

21. The cutter of claim 20, wherein said ultrahard material comprises polycrystalline diamond and at least a portion of said polycrystalline diamond is thermally stable.

22. The cutter of claim 1, wherein an interface between said substrate and said ultrahard material layer comprises at least one selected from a non-planar geometry and a layer of transition material disposed there between.

23. The cutter of claim 1, wherein L is equal to about 19 mm, W is equal to about 13 mm and said cutter comprises a cutting face surface area that is greater than 200 $mm^2$.

24. An earth boring fixed cutter drill bit for drilling through subterranean earth formations, comprising:

a bit body having first end adapted to connect to a drill string and a cutting end opposite said first end, said cutting end comprising preformed sockets formed therein; and cutters mounted in said sockets, wherein a plurality of said cutters each comprise:

a base portion with a longitudinal axis that extends through a center of said base portion, wherein said base portion comprises a peripheral geometry configured to engage in the sockets of corresponding shape in multiple orientations; and a planar cutting face disposed on an end opposite said base portion and arranged generally perpendicular to said longitudinal axis and centered with respect to said base portion such that said longitudinal axis extends through a center of said planar cutting face, wherein said base portion and said planar cutting face including a periphery edge comprising:

a first arcuate segment and a second arcuate segment spaced apart and arranged opposite each other with linear segments disposed there between joining said first and said second arcuate segments, said base portion and planar cutting face spanning a maximum edge-to-edge dimension L along a first direction corresponding with a major axis of said base portion and planar cutting face which intersects said first and second arcuate segments, and spanning a maximum edge-to-edge dimension W in a second direction perpendicular to said first direction, wherein said plurality of said cutters are arranged in said sockets with the major axes of the cutters projects generally outwards from the surface of the bit body.

25. The bit as claimed in claim 24, wherein said cutting end further comprises a plurality of blades extending generally outwardly away from the central longitudinal axis of rotation of the bit and said sockets being formed in said blades.

26. The bit as claimed in claim 24, wherein at least one of said plurality of cutters has a cutting face exposure height, h, above a surface of the bit body that is greater than 7 mm.

27. The bit as claimed in claim 24, wherein the base of at least one of said plurality of cutters has a geometry which permits a mounting of said base in a corresponding socket in a first orientation and a second orientation rotated 180° from said first orientation.

28. The bit of claim 24, wherein said bit includes a cutting profile and said plurality of cutters are mounted in their corresponding sockets with their major axes projects outwards in a direction normal to said cutting profile.

29. The bit of claim 24, wherein said bit includes a cutting profile and one or more cutters arranged in a row forming a forward or a backward spiral along at a portion of said bit body are mounted in their corresponding sockets with their major axes projecting outwards from the bit body at a angle of between 1° and 15° with respect to line normal to said bit profile.

30. The bit of claim 29, wherein and said one or more cutters are arranged with their major axes positioned generally normal to their expected corresponding maximum wear flat plane.

* * * * *